United States Patent [19]

Nutter et al.

[11] 4,033,234

[45] July 5, 1977

[54] THROTTLE VALVE OPERATOR

[75] Inventors: Norman E. Nutter; Herbert N. Hoffman, both of Lunenburg, Mass.

[73] Assignee: General Electric Company, Schenectady, N.Y.

[22] Filed: June 2, 1975

[21] Appl. No.: 582,705

[52] U.S. Cl. ..... 91/384; 91/450; 251/25

[51] Int. Cl.[2] ..... F15B 9/10

[58] Field of Search ..... 91/48, 49, 440, 358, 91/367, 368, 384, 450; 251/25

[56] References Cited

UNITED STATES PATENTS 2,878,785 3/1959 Rexford ..... 91/47

*Primary Examiner*—Irwin C. Cohen

*Attorney, Agent, or Firm*—John F. Ahern; James W. Mitchell

[57] ABSTRACT

The disclosure relates to a valve operator which may be used for controlling an inlet valve to a steam turbine. The valve operator has a trip position for rapidly closing the steam inlet valve and a reset position whereby the position of the steam inlet valve may be hydraulically controlled. The valve operator includes a manual operator and a remote powered operator. A trip relay and a reset pilot are fluidly interconnected so that the valve operator must be reset after each trip. The valve operator also includes a valve position feedback mechanism.

1 Claim, 1 Drawing Figure

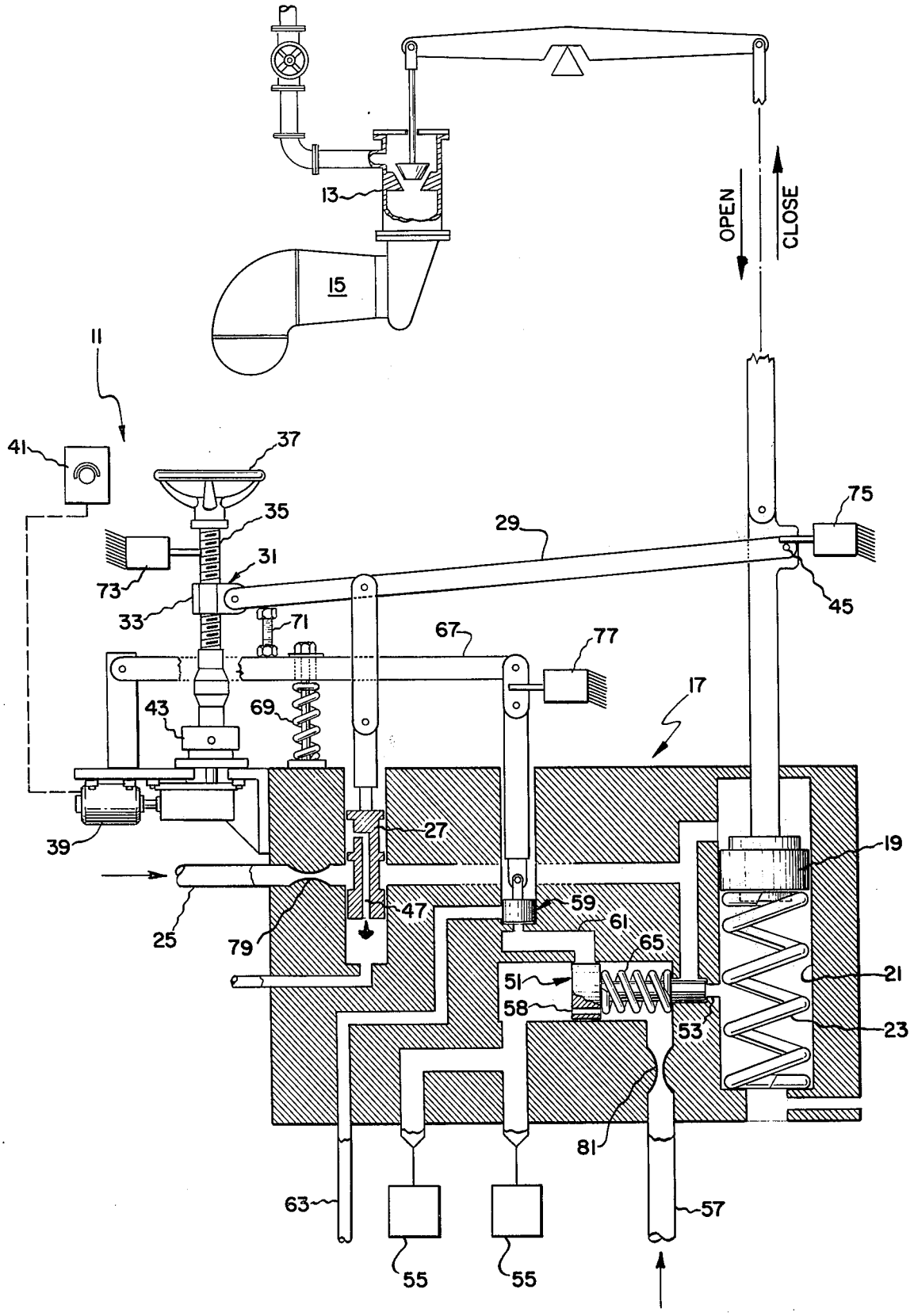
13
15
OPEN
CLOSE
11
41
37
35
31
73
33
71
29
75
45
67
77
17
43
69
39
27
19
25
79
47
59
61
65
51
58
53
21
23
81
63
57
55
55

THROTTLE VALVE OPERATOR

BACKGROUND OF THE INVENTION

This invention relates to the control of turbomachines and, in particular, relates to a valve operator for opening and closing inlet valves to the turbomachine.

In a prime mover, for example, a steam turbine, the steam inlet valve is hydraulically controlled by a valve operator. The valve operator is required to open and close the steam inlet valve in response to a valve command input and, moreover, the valve operator must be above to rapidly shut the steam inlet valve in response to a trip command. The valve operator should be capable of receiving a valve command input from a remote location. For example, for a marine steam turbine it is desirable to be able to control the valve operator and steam inlet valve from a bridge location as well as from the engine room. Moreover, it is also required that the valve operator be manually operable in the event that remote control fails.

The present invention satisfies the foregoing specification in the following manner. The valve operator includes a manifold having a valve actuating piston slidable therein, said piston being attached to the steam inlet valve. The piston is hydraulically positionable by a pilot valve. The pilot valve is positioned by a lever which is attached at one end to a linearly movable fulcrum and connected at the other end to the valve actuating piston. The fulcrum is movable by a manual or remote controlled powered operator. The valve operator further includes a trip relay and a reset pilot, said relay and reset pilot being interconected by a fluid passage so that the reset pilot must be reset prior to resetting the trip relay. The lever interconnecting the fulcrum, pilot valve and piston also positions the reset pilot.

It is an object of the present invention to provide a valve operator which may be used to control a turbomachine inlet valve and includes a trip relay for rapidly closing said valve.

It is another object of the present invention to provide a valve operator which may be remotely operated and manually operated.

The novel features believed characteristic of the present invention are set forth in the appended claims. The invention itself, however, together with further objects and advantages thereof, may best be understood with reference to the following description, taken in connection with the appended drawing.

BRIEF DESCRIPTION OF THE DRAWING

The drawing shows a cross section of the valve operator and a schematic representation of a connection between the valve operator and a steam turbine.

DETAILED DESCRIPTION OF THE INVENTION

A valve operator 11 is shown for controlling an inlet throttle valve 13 in a steam turbine 15. Accordingly, a hydraulic manifold 17 includes a valve actuating piston 19 slidable within a hydraulic cylinder 21 formed within the manifold. The piston is biased in the valve close position by means of a valve closing spring 23 positioned in the hydraulic cylinder.

The position of the piston 19 is controlled by a hydraulic fluid supply through a first fluid inlet conduit 25. The flow to the piston is, in turn, controlled by the position of a pilot valve 27 slidable within the hydraulic manifold and resulting fluid pressure changes caused by restricting orifice 79. The pilot valve position is controlled by a first lever 29 to which the pilot valve is linked at a point between the ends of the lever. The lever position is initially controlled by a pilot valve positioning means 31. The pilot valve positioning means includes a fulcrum nut 33 which is linearly movable upon a threaded rod 35. As the threaded rod is rotated, the nut will raise or lower depending on the direction of rotation of the rod. The threaded rod is manually and locally rotatable by means of a handwheel 37. Moreover, the threaded rod is remotely operable by means of a powered operator or motor 39 which may be actuated by a switch 41 from a remote station. The handwheel and motor are coupled to opposite ends of the rod 35 and the output shaft of the motor 39 includes a clutch 43. The clutch 43 will prevent the motor windings from overheating whenever a limit stop is reached by the fulcrum nut and, moreover, will obviate turning the motor shaft whenever the handwheel is operated.

The lever 29 is connected at one end to the fulcrum nut and is connected at the other end to the piston at pin connection 45. The operation of the valve operator as described so far is as follows. A desired turbine valve position is input into the lever by positioning the fulcrum nut either by using the manual operator or the remote powered operator to rotate the threaded rod. The lowering or raising of the fulcrum nut causes a lowering or raising of the lever 29 and ultimately the pilot valve to determine the fluid pressure and flow through inlet conduit 25 to the upper surface of the valve actuator piston 19. If it is desired to open the steam inlet valve, the piston must be lowered. In order to accomplish this, the fulcrum nut is raised thereby raising the pilot valve to shut off a pilot drain 47 within the pilot valve and indicated by an arrow. Shutting off the drain 47 causes more fluid to be sent up the upper surface of the piston thereby lowering the piston against the force of the valve closing spring. This movement causes lever 29 to drop thereby lowering the pilot valve until a balanced position is reached in a manner known in the art. Closing the inlet valve follows the reverse process whereby the lever is lowered initially by the valve positioning means 31 and then raised by the piston as fluid is drained from above the piston.

A trip relay 51 is included for overriding said pilot valve position by dumping fluid through a first drain 53 from above the piston. The trip relay is actuated by one or more trip devices 55 which are well known in the art. If a trip is actuated, the trip relay will uncover drain 53 as it moves to a tripped position.

After a trip has been initiated, the valve operator must be reset. A second fluid inlet conduit 57 supplies pressurized fluid to the trip relay. The trip relay is fluidly connected to a reset pilot 59 through conduit 61. In the tripped position, the reset pilot is moved to uncover a second drain 63. Therefore in the tripped position fluid pressure drops across orifice 81 and the second fluid inlet conduit is drained through the trip relay and reset pilot drain.

In order to initiate a reset, the reselt pilot is moved down (in a manner to be described) to cover the second drain 63. Closing drain 63 causes the fluid from second conduit 57 to flow through a passage 58 in the trip relay thereby ultimately closing drain 53 because of a differential surface area. In this manner the valve operator is reset. Biasing means or spring 65 keeps the trip relay from sticking in the reset position. It is apparent from this construction that after each trip, the reset pilot must be reset.

The reset pilot is reset by a second or reset lever 67 which is linked to the reset pilot. The lever 67 is biased to the tripped position by means of spring 69. The reset pilot is reset by means of bolt 71 which enables second lever 67 to follow first lever 29. In other words, the fulcrum nut must lower the lever 29 against the lever 67 to cause a reset of the reset pilot after each trip. After the trip relay has been reset, the reset pilot is free to follow the lever 29 to a more open position so that upon the occurrence of a trip the reset relay will already be in the trip position thereby obviating the reset pilot from rising rapidly during a trip. The valve open position, valve close position and reset position are remotely indicated by limit switches 73, 75 and 77 respectively.

Assuming a trip has occurred, the operation of the valve operator is as follows. The fluid in the first inlet conduit 25 is drained through a first drain 53 causing piston 19 to raise thereby closing valve 13. The fulcrum nut is lowered to cause bolt 71 to lower second lever 67 until the reset pilot 59 is reset. Resetting of the reset lever causes second drain 63 to be shut off and trip relay 51 to be reset by fluid from the second inlet conduit 57. In the reset position, drain 53 is cut off. Thereafter, the fulcrum nut 33 and lever 29 are raised, closing off pilot drain 47 which lowers the piston and opens throttle valve 13. The piston causes lever 29 to be raised until the desired valve opening is reached.

While there is shown what is considered at present to be the preferred embodiment of the invention, it is, of course, understood that various other modificatons may be made therein. It is intended to claim all such modifications as fall within the true spirit and scope of the present invention.

What is claimed is:

1. A valve operator for opening and closing a main valve to which the valve operator is connected, said valve operator comprising:

a manifold block including a hydraulic cylinder having a main valve actuating piston slidable therein and biased by spring means in a valve close direction;

a first fluid inlet conduit for supplying hydraulic fluid to said hydraulic cylinder; a pilot inlet and exhaust valve disposed within said first fluid inlet conduit for controlling the flow of hydraulic fluid to said hydraulic cylinder; means for positioning and repositioning said pilot valve according to a desired main valve position including a first lever interconnecting a linearly movable fulcrum with said valve actuating piston and said pilot valve;

a pressure responsive trip relay valve connecting the first conduit and hydraulic cylinder with a first drain, said trip relay valve biased by spring means in an open direction;

trip device for controlling said trip relay valve;

a second fluid inlet conduit for supplying hydraulic fluid to close the trip relay valve upon the reset of said trip device; and, a reset pilot valve for placing in fluid communication a drain and said second inlet conduit through said trip relay valve when said trip relay valve is in an open position; a pivotally mounted second lever connected to said reset pilot valve to direct said reset pilot valve to a closed position, said second lever including means for following said first lever in the main valve open direction, said second lever being biased by spring means to open said reset pilot valve in following said first lever after the trip relay valve has been closed.

* * * * *